United States Patent [19]

Kurtz

[11] Patent Number: 5,009,142

[45] Date of Patent: Apr. 23, 1991

[54] MEANS AND METHOD FOR AUTOMATIC RESONANCE TUNING

[76] Inventor: Noel T. Kurtz, 186 Besemer Hill Rd., Ithaca, N.Y. 14850

[21] Appl. No.: 498,728

[22] Filed: Mar. 26, 1990

[51] Int. Cl.[5] ..... G10G 7/02

[52] U.S. Cl. ..... 84/454; 84/DIG. 12

[58] Field of Search ..... 84/454, 455, DIG. 24; 310/321, 323; 73/579, 580, 581

[56] References Cited

U.S. PATENT DOCUMENTS

| | | | |
|---|---|---|---|
| 3,813,983 | 6/1974 | Paul | 84/454 X |
| 4,023,462 | 5/1977 | Denov et al. | 84/454 |
| 4,044,239 | 8/1977 | Shimauchi et al. | 84/455 X |
| 4,088,052 | 5/1978 | Hedrick | 84/454 |
| 4,160,401 | 7/1979 | Tomioka | 84/DIG. 24 |
| 4,196,652 | 4/1980 | Raskin | 84/454 X |
| 4,297,938 | 11/1981 | Kirby | 84/455 |
| 4,319,515 | 3/1982 | Mackworth-Young | 84/454 |
| 4,375,180 | 3/1983 | Scholz | 84/454 |
| 4,426,907 | 1/1984 | Scholz | 84/454 |
| 4,584,923 | 4/1986 | Minnick | 84/454 |
| 4,791,849 | 12/1988 | Kelley | 84/454 X |
| 4,803,908 | 2/1989 | Skinn et al. | 84/454 |
| 4,909,126 | 3/1990 | Skinn et al. | 84/454 |

*Primary Examiner*—L. T. Hix
*Assistant Examiner*—Khanh Dang
*Attorney, Agent, or Firm*—Ralph R. Barnard

[57] ABSTRACT

A method and apparatus is provided for the adjustment of resonance on a freely vibrating filament by the use of piezoelectric pushers which are solid state devices whose lengths change as a result of applied voltage. The pushers are configured in such a manner that changes in the pushers' lengths are translated into changes in resonance. The pushers are controlled by feedback circuit wherein frequency of vibration is compared to an electronically generated reference. The resulting error signals are input to DC amplifiers which drive the piezoelectric pushers so as to eliminate the error.

18 Claims, 2 Drawing Sheets

MEANS AND METHOD FOR AUTOMATIC RESONANCE TUNING

BACKGROUND OF THE INVENTION

1. Field of the Invention

The present invention relates to resonance adjustment of freely vibrating bodies. In particular, this invention relates to new and improved apparatus for automatic tuning of stringed musical instruments.

For purposes of the following discussion, the terms "pitch" and "tune" will be used interchangeably and will refer to the fundamental frequency of vibration of an instrument's strings.

2. Description of the Related Art

All stringed musical instruments require tuning due to changes in physical conditions or changes in the characteristics of the materials from which the instruments are made. Many stringed instruments, such as guitars and violins, drift out of tune quite rapidly and musicians often need to make tuning adjustments during the course of a performance.

Stringed instruments are presently manually tuned. The musician adjusts each string's tension (and hence its pitch) by mechanical means, such as worm gears. As there is no direct method for determining when a string is in tune, musicians must either tune their instruments "by ear" or use tuning aids.

Tuning "by ear" means that the musician uses his or her judgment to determine if a note is in tune. It is a difficult process that requires the ability to discern slight variations in pitch.

Tuning aids provide musicians with either an audio or visual reference in order to determine which way the string's pitch needs to be adjusted (higher or lower). Audio tuning aids, such as tuning forks, while considerably easier than tuning "by ear," still require the musician to judge when the string is in tune.

Visual tuning aids, such as those disclosed in U.S. Pat. Nos. 4,023462 (Denov et al), 4,088,052 (Hedrick) and 4,196,652 (Raskin), utilize electronics to measure the frequency of each string and compare it with an electronically generated reference frequency. A visual display is produced, indicating the magnitude and direction of the tuning error. The musician then adjusts each string to eliminate the error. Visual tuning aids allow individuals with very poor tone recognition skills to tune their instruments, but the actual tuning is still performed manually.

There are some tuning devices and tuning apparatus which are automatic in nature, such as those listed in Table I, below.

TABLE I

| Patentee | U.S. Pat. No. | Issue Date |
|---|---|---|
| Scholz | 4,375,180 | March 1, 1983 |
| Scholz | 4,426,907 | January 24, 1984 |
| Minnick | 4,584,923 | April 29, 1986 |
| Skinn et al | 4,803,908 | February 14, 1989 |

Nonetheless, these automatic tuning devices and apparatus rely on methods which are inferior to the method of this invention.

Both Scholz patents rely on tension sensing means for determining frequency. As there is no linear correlation between frequency and tension of a string, this method is inaccurate.

Neither Minnick nor Skinn et al (hereinafter "Skinn") use tension sensing means to determine frequency; both utilize electronic means for comparing signals produced against reference signals. In both cases, a difference between signal produced and reference signal will activate motors which will then adjust string tension.

There are several disadvantages to this type of method. One significant disadvantage is the relative bulk of such a device or apparatus when attached to an instrument. The size of such an apparatus or device would make it difficult to incorporate into a musical instrument, especially the smaller ones (e.g. violins).

Another disadvantage to the methods of Minnick and Skinn is the use of motors to change string tensions. Since the comparison of the output and reference signals is electronic, the accuracy of this method is limited by the mechanical means of adjusting string tension.

Both Minnick and Skinn contemplate the use of motor-driven gears to effectuate actual adjustment of string tension. There is an inherent stability and control problem in the use of gears due to the existence of "backlash" (i.e. the play between two meshing gears). Although this "backlash" can be minimized, it cannot be eliminated altogether. In the course of ordinary use, gears and motors become worn and periodically need replacement. Furthermore, motor driven gears may to slow in response for effective tuning due to the slow response of gear reductions, signal conversions, inertia and inductive phase lag.

Another problem is the feedback associated with the gear train and electric motors. Hysteresis, due to gear backlash, and the phase lag inherent with inductive motors is likely to result in "hunting", where string tension adjustments overshoot the proper level and the system oscillates. None of the aforementioned patent publications address this problem.

The heat generated by servo motors and especially stepper motors, shown by Skinn, is a significant problem. Thermal drift is probably the primary cause of instruments going out of tune. Placing such heat sources within the instrument would make short term tuning drifts inevitable. Thermal cycling is also detrimental to the instrument itself.

The disadvantages pointed out in the prior art referenced above are overcome in this present invention by the elimination of gears and motors and the use of a piezoelectric element to effectuate actual adjustment of string tension.

SUMMARY OF THE INVENTION

In accordance with the present invention, there is provided a new and improved device for automatically tuning stringed instruments by use of a piezoelectric element connected to a lever means to adjust string tension. The piezoelectric pushers are solid state devices whose lengths change as a result of applied voltage. The pushers are controlled by feedback circuits wherein frequency of vibration is compared to an electronically generated reference. The resulting error signals are input to DC amplifiers which drive the piezoelectric pushers so as to effectively tune the string.

It is therefore an object of the present invention to provide an automatic tuning device which can be incorporated into any stringed musical instrument.

For purposes of explaining additional objects of the invention, it is necessary to classify stringed instruments into two categories: (1) those whose strings' pitches are not altered as they are played, and (2) those whose strings' pitches are altered as they are played. Instruments such as pianos and harps belong to the first group and will be referred to as "fixed note" instruments. Guitars and violins are examples of the second and will be referred to as "adjustable note" instruments.

When adjustable note instruments are played, the musician alters the pitch of the strings by shortening their effective length, usually with his or her fingers. These instruments also allow the musician to add vibrato, a cyclical variation of pitch, and otherwise distort the played frequency, by bending the strings. Fully automatic tuning is therefore precluded because tuning adjustments would interfere with the musicians' efforts to control each string's played frequency. Since the pitches of fixed note instrument strings are not altered by the musician as they are played, the strings' pitches can be continuously monitored and adjusted.

It is therefore another object of the present invention to provide a semi-automatic tuning device for adjustable note stringed instruments which will tune on a demand basis.

It is still another object of the present invention to provide fully automatic continuous tuning of fixed note stringed instruments.

The basic embodiment of the invention allows for considerable variation with regard to configuration. It also allows for additional capabilities other than automatic tuning of stringed musical instruments.

Further objects, features and advantages may be found in the following drawing, specification and claims.

DETAILED DESCRIPTION OF THE INVENTION

Figure 1:
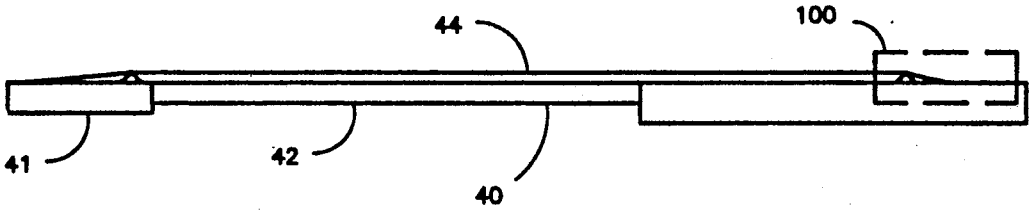
FIG. 1 is a schematic cross section of an electric guitar incorporating the invention.
Figure 2:
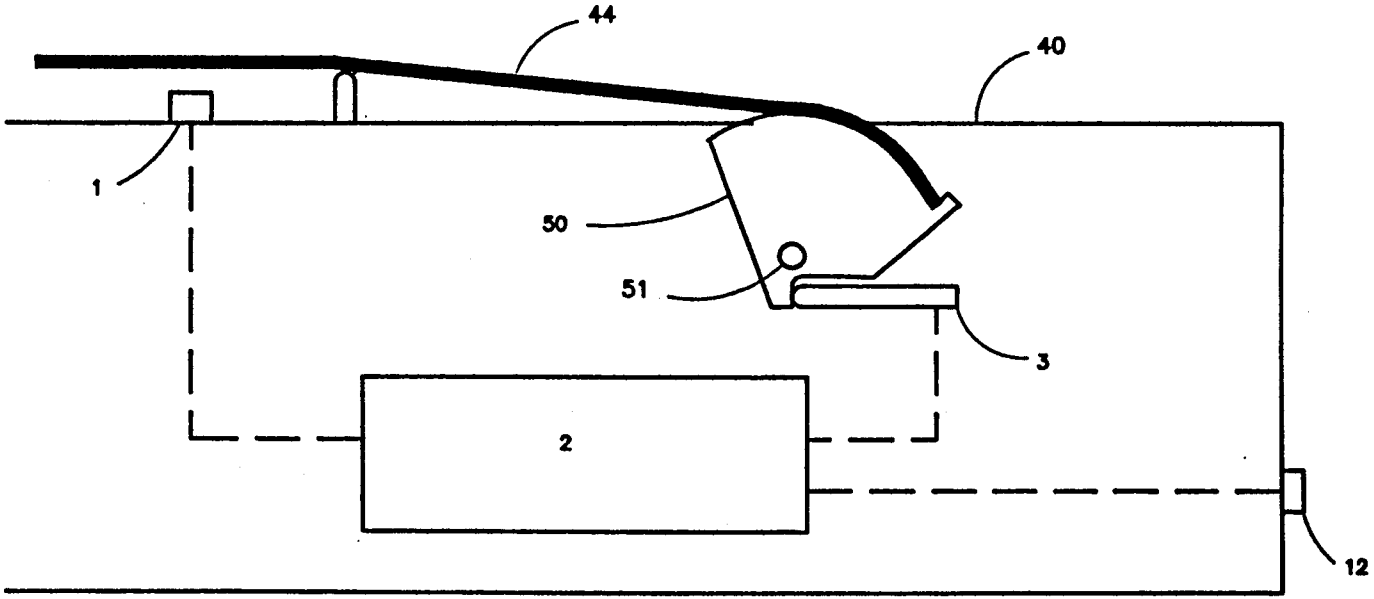
FIG. 2 is an enlargement of the area 100 shown in FIG. 1. The area 100 is a schematic detail of the physical apparatus of the invention incorporated in the tail piece of an electric guitar.
Figure 3:
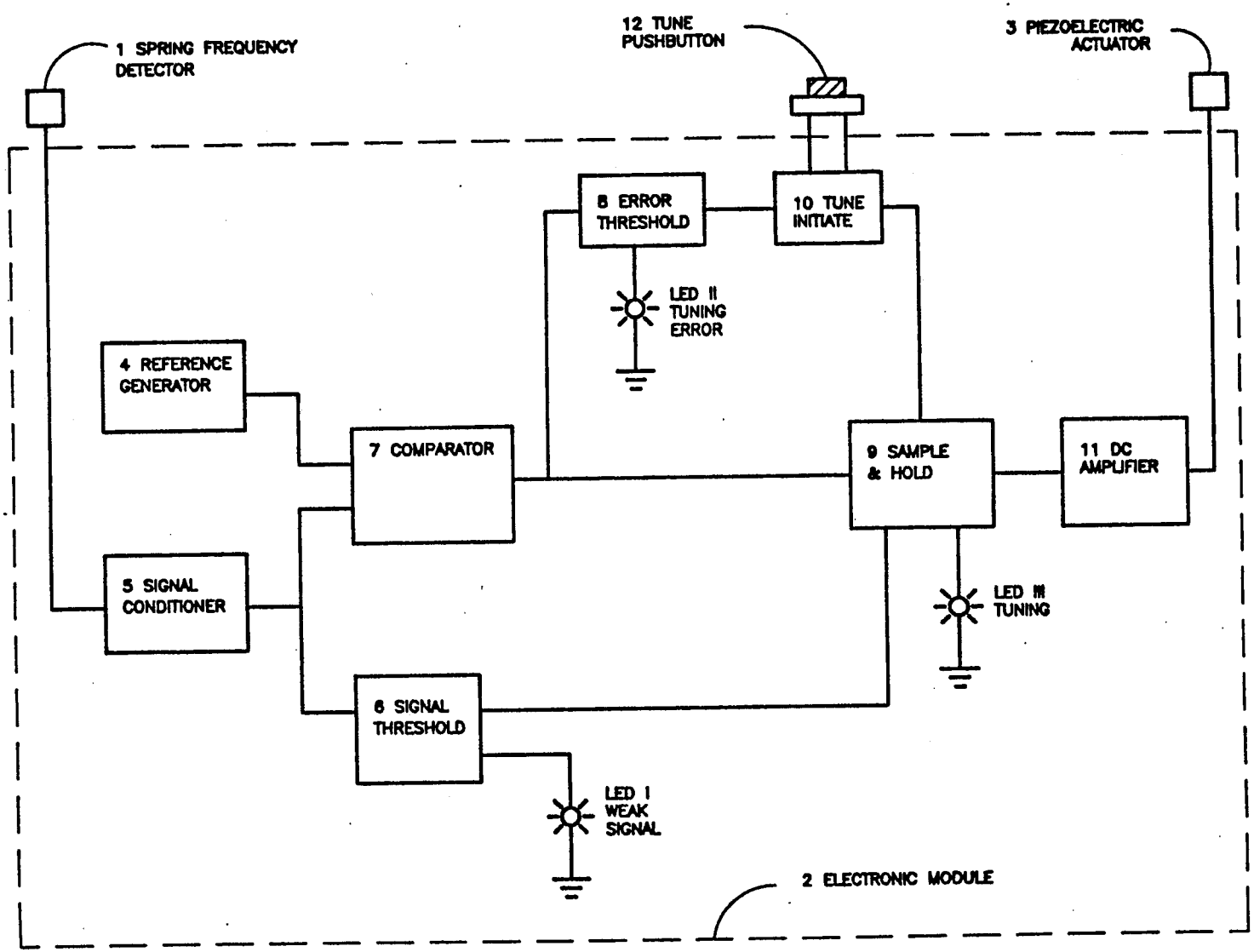
FIG. 3 is a block diagram of the invention.

FIGS. 1 and 2 illustrate a typical embodiment in which the invention is built into the tail piece 41 of an electric guitar 40. The invention is physically cOmprised of four subassemblies connected by wiring. Referring to FIG. 3, they are the String Frequency Detector 1, Electronic Module 2, Piezoelectric Pusher Actuator 3, and Tune Pushbutton 12. For simplicity in presentation, only one string 44 of the instrument 40 is illustrated; however, each string 44 would be identically equipped. The Tune Pushbutton 12 would simultaneously initiate tuning in all strings 44.

Referring again to FIG. 3, the String Frequency Detector 1 provides the input to the Electronic Module 2. The first element of the Electronic Module 2 is the Signal Conditioner 5. Conditioning consists of amplification and band-pass filtering. The conditioned signal is then input to the Comparator 7 and Signal Threshold 6. The Signal Threshold circuit prevents tuning adjustments when the String Frequency Detector signal is too weak (see further discussion below) and indicates a weak signal condition via LED II. The Reference Signal Generator 4 provides the reference signal of the desired frequency to the Comparator 7. The Comparator 7 produces a DC output proportional to the difference between the reference signal frequency and the string's actual resonance frequency. This error signal is then input to the Sample & Hold circuit 9 and the Error Threshold circuit 8. The Sample & Hold circuit 9 enables tuning adjustments when in sampling mode and disables tuning adjustments when in hold mode (see further discussion below). The Error Threshold circuit 8 indicates an out-of-tune condition via LED I and provides a no-tuning-error signal to the Tune Initiate circuit 10. The Tune Initiate circuit 10 enables tuning when the Tune Pushbutton 12 is pushed and disables tuning when it receives a no-tuning-error signal from the Error Threshold 8. The Sample & Hold output is amplified to appropriate voltage by the DC Amplifier 11 whose output controls the Piezoelectric Pusher Actuator 3.

In normal operation, with the instrument in tune, the Sample & Hold circuit 9 would be in hold mode. Its output would remain at the level of the last tuning adjustment, thus holding the Piezoelectric Pusher Actuator 3 in position to maintain tune. As the instrument is played, LED I would light because the Comparator 7 would be detecting large tuning errors due to the altering of the strings, pitches by the musician. To check the tune, the musician would strum the strings 44 in the "open position," that is, without influencing the strings' pitches by fingering them. If a string 44 is out of tune, its Comparator's tuning error output would exceed the Error Threshold circuit's limit, and LED I would light. The musician would then initiate tuning by pressing the Tune Pushbutton 12, which would switch the Tune Initiate circuit 10 into tune mode. However, if the strings 44 are not vibrating, there would not be a sufficiently strong String Frequency Detector signal for proper Comparator 7 operation. The Signal Threshold circuit 6 is therefore needed to keep the Sample & Hold circuit 8 in hold mode, thus ignoring Comparator 7 output, when the String Frequency Detector signal is too weak. In that case, the Signal Threshold circuit 8 would light LED I. Upon seeing the lit LED I, the musician would strum the strings 44 and provide a sufficiently strong String Frequency Detector signal. The Signal Threshold circuit would then produce an adequate-signal output that would fully enable the Sample & Hold circuit's sample mode. In sample mode, the Comparator output is passed through the Sample & Hold circuit 9 to the DC Amplifier 11. The DC Amplifier output is then applied to the Piezoelectric Pusher Actuator 3 which alters the resonance frequency of the string 44, thus adjusting its tune (see discussion below). When the Sample & Hold circuit 9 is in sample mode, the entire system comprises a negative feedback circuit which acts to eliminate the difference between the string's resonance frequency and the generated reference frequency, thus tuning the string 44.

When the tuning error has been reduced to a preset limit, the Error Threshold Circuit 8 produces a no-tuning-error output. The Tune Initiate circuit 10 then disables tuning, forcing the Sample & Hold circuit 9 into hold mode.

Referring now to FIG. 2, the Piezoelectric Pusher Actuator 3 adjusts string resonance through a Cam 50. The Cam 50 pivots about Cam axis 51 to provide mechanical amplification of the Piezoelectric Pusher's range of motion. This amplification is desirable because it results in a maximum range of automatic tuning operation. The range of tuning available is a function of the guitar string's physical properties, and the range and force of the Piezoelectric Pusher Actuator 3.

The tune of a string is determined by its fundamental resonance frequency of vibration, which is governed by Equation 1:

$$f=(\tfrac{1}{2}L)(T/M)^{0.5}$$

(Musical Acoustics, Donald E. Hall) where f is the frequency, L is the length of the string, T is string tension and M is the string mass per unit length. From Equation 1, it can be seen that the string's tune is inversely proportional to its length (L), proportional to the square root of its tension (T) and inversely proportional to the square root of its mass per unit length (M).

All of the strings of a guitar are the same length, approximately 0.65 m. The tune of each guitar string is therefore dependent on its tension and mass per unit length. In order to have balanced forces in the guitar neck 42, the mass per unit length of the strings is varied so that the required tension is roughly equal for all strings. Rearranging Equation 1 results in Equation 1A:

$$T=M(2Lf)^2$$

from which it can be seen that the string 44 mass per unit length (M) must vary in inverse proportion to the square of the frequency ($f^2$) to maintain equal string 44 tensions. This is accomplished by using heavier strings for the lower notes.

The tension of a string 44 is also governed by Equation 2:

$$T=eAE/L$$

(Statics and Strengths of Materials, Stevens) where e is the string strain, A is the cross sectional area of the string, E is the modules of elasticity and L is again the string length. The string strain (e) is the distance the string 44 must be stretched in order to achieve tension (T). Since the tension (T) of all the strings 44 is roughly equal, it can be seen that the required strain (e) is inversely proportional to the string diameter (A). Thus the smallest string 44 requires the largest strain, and is therefore the worst case in terms of automatic tuning.

The smallest string 44 of an electric guitar is usually tuned to E which corresponds to a frequency of about 330 hertz. The diameter of a typical E string is approximately 0.0002 m. With a density of steel of 7800 kg/m$^3$, the string mass per unit length is found to be:

$$(7800\ kg/m^3)\ (\pi)\ ((0.0002\ m)(\tfrac{1}{2}))^2=0.000245\ kg/m.$$

Solving Equation 1A for T with f=330 Hz, M=0.000245 kg/m and L=0.65 m results in a string tension of 4.6 kg. A typical commercial piezoelectric pusher (Burleigh PZL-060)has a maximum force of approximately 55 kg and a travel of 60 microns. With the string tension rounded up to 5 kg, the maximum amplification of the pusher travel is 11 and the maximum string strain produced by the amplified piezoelectric pusher range of motion is 660 microns (0.00066 m).

Combining Equations 1A and 2 and solving for strain results in Equation 3:

$$e=(2Lf)^2(ML/EA)$$

where e is the total change in string 44 length required for the string 44 to vibrate at frequency f. With $E=2.07\times10^{11}$ Newtons/m$^2$ for steel and with other values from above, the total strain needed to bring the E string 44 into tune is 0.0045 m. Since the available range of the Piezoelectric Pusher Actuator 3 is 0.00066 m, the E string must be manually adjusted to plus or minus seven percent (±7%) of the desired frequency before the invention can bring the string into final tune. This represents a very coarse adjustment (approximately plus or minus 2 notes) and would generally only be necessary when initially tuning new strings. From the above, it can be seen that strings of lower frequency would require less manual coarse adjustment.

There are a multitude of devices and alternate configurations that could be used for the components and subcircuits illustrated above. For example, the reference frequency generator 4 could consist of a quartz crystal oscillator coupled with a frequency divider circuit or a commercial integrated circuit timer chip. The comparator function 7 could be accomplished with a phase-locked loop amplifier or by using digital circuitry. The String 44 Frequency Detector 1 could be a standard magnetic pickup as currently used in electric guitars, a pressure transducer, or strain gauge. The essential element of the invention is the use of the piezoelectric pusher 3 in a negative feedback configuration to adjust the string's resonance, and hence its tune.

While the preferred embodiment illustrated is for an electric guitar, incorporation with other string 44 instruments would be similar. The invention can be retrofitted to existing stringed instruments. Minor modifications to the invention would allow additional capabilities which include, but are not limited by:

1. Automatic string excitation during the tuning cycle

In the preferred embodiment illustrated, the musician must manually excite the strings to provide adequate signal strength to the Electronics Module 2; however, with the addition of appropriate circuitry, the Piezoelectric Pusher Actuator 3 could be utilized to excite the strings 44. In this configuration, the first step of the tuning sequence would be a burst of AC voltage applied to the piezoelectric pushers of sufficient power and duration to start the strings 44 vibrating. The tuning process would then continue as described above. Other means of automatic excitation, such as the addition of separate piezoelectric pushers for string 44 excitation, are available.

2. Automatic key changes

With additional circuitry, the invention could tune the strings to different notes, thus changing the instrument's key, on the basis of switch selection, etc. from the musician.

3. Enhanced sound capabilities

With additional circuitry, the invention could provide programmed distortions of the string's pitches. An example of this is automatic vibrato which can be achieved by superimposing an AC signal over the piezoelectric pusher DC control voltage. The magnitude and frequency of the AC signal would be selected by the musician and would determine the character of the vibrato.

The foregoing description has been directed to particular embodiments of the invention in accordance with the requirements of the Patent Statutes for the purposes of illustration and explanation. It will be apparent, however, to those skilled in this art that many modifications and changes will be possible without departure from the scope and spirit of the invention. It is intended that the following claims be interpreted to embrace all such modifications.

What is claimed is:

1. An apparatus for adjustment of resonance frequency of a filament, comprising:

(a) a piezoelectric actuator that changes in length as an electric field is applied thereto and is connected to said filament either directly or through means for amplifying the movement of said piezoelectric actuator such that a change in the length of said piezoelectric actuator changes the tension of said filament, (b) means for measuring frequency of said filament, (c) means for controlling resonance frequency adjustment connected to said means for measuring resonance frequency and said piezoelectric actuator such that said means for controlling frequency adjustment adjusts the resonance frequency of said filament by varying said electric field applied to said piezoelectric actuator.

2. The apparatus of claim 1 further comprising:

(a) lever means with an axis for increasing the amplitude of the range of motion of said piezoelectric actuator, (b) one end of said lever means operably connected to said filament and the other end of said lever means connected to said piezoelectric actuator, (c) said axis about which said lever means rotates positioned to maximize the increase in amplitude of the range of motion of said piezoelectric actuator.

3. The apparatus of claim 2 wherein said means for controlling resonance frequency adjustment comprises:

(a) means for generating a reference frequency, (b) means for conditioning said actual resonance frequency signal, (c) comparator means for measuring the difference between said reference frequency and said conditioned actual resonance frequency, (d) processing means for converting said measured frequency difference to an electrical output, said electrical output used to control resonance frequency adjustment by controlling motion of said piezoelectric actuator.

4. The apparatus of claim 3 wherein said means for conditioning said actual resonance frequency further comprises: means for providing a signal threshold, below which there can be no comparative measurement of frequency by said comparator means, and means for indicating weak signal.

5. The apparatus of claim 4 wherein said means for controlling resonance frequency adjustment further comprises means for providing an adjustable error threshold, below which there can be no initiation of resonance frequency adjustment.

6. The apparatus of claim 5 wherein said filament is a string on a stringed musical instrument.

7. The apparatus of claim 6 wherein each string on said stringed musical instrument has said apparatus attached thereon.

8. The apparatus of claim 7 wherein said means for measuring resonance frequency is a magnetic pickup.

9. The apparatus of claim 8 wherein said means for controlling of resonance frequency adjustment further comprises a means for automatic initiation of resonance frequency adjustment.

10. The apparatus of claim 8 wherein said means for controlling of resonance frequency adjustment further comprises a means for manual initiation of resonance frequency adjustment.

11. A method for resonance frequency adjustment of a freely vibrating body, comprising the steps of:

(a) detecting the actual resonance frequency of a freely vibrating body, (b) comparing said actual resonance frequency of said freely vibrating body with a reference frequency and measuring the difference, (c) converting said measured difference in frequency into an electronic output, (d) amplifying said electronic output and using said amplified electronic output to control the motion of a piezoelectric actuator, (e) amplifying the motion of said piezoelectric actuator by means of a lever mechanism to effectuate a change in resonance frequency of said freely vibrating body.

12. The method of claim 11 wherein said freely vibrating body is an elongated stretched filament.

13. The method of claim 12 wherein said elongated stretched filament is a string on a stringed musical instrument.

14. The method of claim 13 wherein said means for initiating resonance frequency adjustment is automatic.

15. Apparatus for resonance frequency adjustment of a freely vibrating body, comprising:

(a) a piezoelectric actuator that changes in length as an electric field is applied thereto and is connected to said freely vibrating body either directly or through means for amplifying the movement of said piezoelectric actuator such that a change in the length of said piezoelectric actuator changes the tension of said freely vibrating body, (b) means for measuring resonance frequency of said freely vibrating body, (c) means for controlling resonance frequency adjustment connected to said means for measuring resonance frequency and said piezoelectric actuator such that said means for controlling frequency adjustment adjusts the resonance frequency of said freely vibrating body by varying said electric field applied to said piezoelectric actuator.

16. The apparatus of claim 15, further comprising:

(a) lever means with an axis for increasing the amplitude of the range of motion of said piezoelectric actuator, (b) one end of said lever means operably connected to said freely vibrating body and the other end of said lever means located adjacent to said piezoelectric actuator (c) said axis about which said lever means rotates positioned to maximize the increase in amplitude of the range of motion of said piezoelectric actuator.

17. The apparatus of claim 16 wherein there are a plurality freely vibrating bodies each connected to one of said resonance frequency adjustment apparatus, such that said means for controlling frequency adjustment apparatus, such that said means for controlling frequency adjustment of each of said apparatus are connected and coordinate the adjustment of the resonance frequency of each of said freely vibrating bodies relative to one another.

18. The apparatus of claim 16 wherein said freely vibrating body operably connected at one end to said lever means is a filament.

* * * * *